US008668450B2

(12) United States Patent
Chevrette

(10) Patent No.: US 8,668,450 B2
(45) Date of Patent: Mar. 11, 2014

(54) REMOVABLE UPPER STEAM GUIDE SEGMENT FOR STEAM TURBINE

(75) Inventor: Richard Jon Chevrette, Troy, NY (US)

(73) Assignee: General Electric Company, Schenectady, NY (US)

( * ) Notice: Subject to any disclaimer, the term of this patent is extended or adjusted under 35 U.S.C. 154(b) by 741 days.

(21) Appl. No.: 12/980,624

(22) Filed: Dec. 29, 2010

(65) Prior Publication Data

US 2012/0171031 A1 Jul. 5, 2012

(51) Int. Cl.
*F01D 25/24* (2006.01)

(52) U.S. Cl.
USPC ..... 415/211.2; 415/213.1

(58) Field of Classification Search
USPC ..... 415/211.2, 213.1, 227; 29/888.02, 29/889.2, 889.22
See application file for complete search history.

(56) References Cited

U.S. PATENT DOCUMENTS

| | | | | |
|---|---|---|---|---|
| 3,860,359 | A * | 1/1975 | De Feo | 415/208.2 |
| 4,391,566 | A * | 7/1983 | Takamura | 415/211.2 |
| 6,971,842 | B2 | 12/2005 | Luniewski et al. | |
| 2007/0081892 | A1 | 4/2007 | Sharrow | |

FOREIGN PATENT DOCUMENTS

JP 56072206 A * 6/1981

* cited by examiner

*Primary Examiner* — Dwayne J White
(74) *Attorney, Agent, or Firm* — Ernest G. Cusick; Frank A. Landgraff

(57) ABSTRACT

An upper steam guide segment may be a height limiting clearance for a lift of the upper exhaust hood of a steam turbine. The upper steam guide segment for a steam turbine is made detachable from a steam guide. The upper steam guide segment is bracketed to a butterfly plate fixedly attached to an upper exhaust hood of the steam turbine. The upper steam guide segment is supported by the butterfly plate when detached from the full steam guide. During a lift of the upper exhaust hood, the steam guide segment will also be lifted with the upper exhaust hood, resulting in a lower clearance height for the lift.

20 Claims, 7 Drawing Sheets

REMOVABLE UPPER STEAM GUIDE SEGMENT FOR STEAM TURBINE

BACKGROUND OF THE INVENTION

The invention relates generally to steam turbines and more specifically to maintenance operations requiring access to components within the exhaust hood of the steam turbine.

The outer shell of a steam turbine low-pressure section is generally called the exhaust hood. The primary function of an exhaust hood is to divert the steam from the last stage bucket of an inner shell to the condenser with minimal pressure loss. Usually the lower half of the exhaust hood supports an inner casing of the steam turbine and also acts as a supporting structure for the rotor. The upper exhaust hood is usually a cover to guide the steam to the lower half of the hood. The hood for large double-flow low-pressure steam turbines is of substantial dimensions and weight and usually is assembled only in the field. In many steam turbines, the inner case of the steam turbine, for example a double flow/down exhaust unit has an encompassing exhaust hood split vertically and extending along opposite sides and ends of the turbine. This large, box-like structure houses the entire low-pressure section of the turbine. The exhaust steam outlet from the turbine is generally conically-shaped and the steam exhaust is redirected from a generally axial extending flow direction to a flow direction 90 degrees relative to the axial flow direction. This 90-degree flow direction may be in any plane, downwardly, upwardly or transversely. Thus the exhaust hoods for steam turbines constitute a large rectilinear structure at the exit end of the conical section for turning and diffusing the steam flow at right angles.

The lower half of the exhaust hood, split horizontally from the upper half, directs the exhaust flow of steam to a condenser usually located generally beneath the exhaust hood. The lower exhaust hood may support the inner casing of the turbine and the associated steam path parts such as diaphragms and the like. The lower exhaust hood is further loaded by an external pressure gradient between atmospheric pressure on the outside and near-vacuum conditions internally. The lower exhaust hood shell is generally of fabricated construction with carbon-steel plates. Typical sidewalls for the lower exhaust hood are flat and vertically oriented. To provide resistance to the inward deflection of the sidewalls under vacuum loading, the lower exhaust hood traditionally has included internal transverse and longitudinal plates and struts. These internal transverse and longitudinal plates and struts form a web, generally underneath the turbine casing and extending to the sidewalls.

FIG. 1 illustrates typical arrangements of a prior art low-pressure double-flow steam turbine 5 with an exhaust hood 10. The exhaust hood 10 includes an upper exhaust hood 15 and a lower exhaust hood 20, mating at a horizontal joint 22. A turbine inner casing 25 may be supported on the lower exhaust hood 20. Various supporting structures are present in the form of transverse plates 40. These transverse plates 40 avoid the suction effect of the sidewalls 45 and end walls 50 and they distribute the load applied on the hood due to loads on inner casing 25. The lower exhaust hood 20 further provides a support location for shaft seals (not shown) and end bearings 75 for the turbine rotor 70. The lower exhaust hood 20 may include a framework that rests on the external foundation (not shown). Bearing housings 75 for the turbine rotor 70 are provided at axial ends of the exhaust hood 10.

A steam inlet 30 may penetrate a top of the upper exhaust hood 15 and include a seal 55 with the upper exhaust hood. The steam inlet 30 admits steam into steam chest 35 of the turbine inner casing 25. The steam inlet 30 is usually fabricated integral to the inner turbine casing 25. However, a removable steam inlet assembly 130 (FIG. 9) may be provided that includes a flanged joint 131 (FIG. 9) at the steam inlet to the turbine inner casing. This removable steam inlet assembly 130 may be detached from the steam inlet and attached to the upper exhaust hood with a lifting fixture as described in Docket 245789 by Chevrette and assigned to General Electric Company. Steam from steam inlet 30 is directed by series of fixed stator vanes 60 to rotating blades 61 for driving a turbine rotor 70. Steam exhausts from the turbine inner casing 25 at last stage blades 65.

In the constructing of an effective exhaust hood for use with such an axial flow turbine it is desirable to avoid acceleration losses within any guide means employed therein and to achieve a substantially uniform flow distribution at the discharge opening of the exhaust hood for the most efficient conversion of energy in the turbine and effective supplying of exhaust steam to the condenser to which it is connected. The static pressure at the discharge side of the diffuser will be higher than that of the exhaust hood discharge by the amount of pressure drop required to turn the flow from nearly axial to vertical and by the necessary pressure drop caused by passage of pipes, struts, and other such interferences.

A generally bell-shaped steam guide 90 may direct exhaust steam from the outlet of the turbine inner casing 25. The lower half of the steam guide 91 directs the exhaust steam downward into the lower exhaust hood 20. An upper section of the steam guide 92 exhausts upward to the top of the upper exhaust hood 15. At the top, much of the flow must be turned 180 degrees to place it over the steam guide 90 and inner casing 25, then turned downward. Pressure at the top is thus higher than at the sides, which are in turn higher than at the bottom. Structures within the upper exhaust hood may facilitate and smooth the turning of the exhaust steam downward to the exhaust hood outlet to a condenser below (not shown).

FIG. 2 illustrates an isometric cutaway view of a prior art upper exhaust hood 100. This particular upper exhaust hood includes a frame 110 supporting shell 150 enclosing the top of the upper exhaust hood. Endwalls 124 enclose the ends of upper exhaust hood. Horizontal joint 122 includes mechanical closure elements 130 to join with lower exhaust hood (not shown). The upper exhaust hood 100 also includes a butterfly plate 182. The butterfly plate 182 may include a first plate portion and a second plate portion 186 coupled to first portion 184. In the exemplary illustration, plate portions 184 and 186 are mirror images of each other. In another variations, butterfly plate 182 may be of unitary construction. More specifically, in the exemplary illustration, butterfly plate 182 has a substantially elliptical cross-sectional profile. Inlet steam entering inlet 30 (FIG. 1) passes through center opening 140 of shell 150 and is directed by an inner cylinder/shell (FIG. 1) through the steampath of turbine inner casing below (not shown). When the steam exits the last stage of the turbine inner casing substantially axially, the steam contacts the shell endwall 124 and reverses direction. Butterfly plate 182 directs the steam in the upper exhaust hood 100 into the lower exhaust hood (FIG. 1) and subsequently into the condenser. Additionally, butterfly plate 182 facilitates limiting an amount of exhaust steam, which is at a cooler operating temperature than the inlet steam, from contacting hot steam inlet surfaces. Butterfly plate portions 184 and 186 each may extend radially inwardly from casing inner surface 172 to a contoured radially inner surface 182 of portions 184 and 186.

A pair of support structures 200 may extend radially inward from an inner surface of each butterfly plate portion 184 and 186. Support structures 200 may include a center support rib (not shown) that extends between each respective plate portion 184 and 186 to opening 140, and a pair of side supports (not shown) that extend between center support rib and hood inner surface 172. Accordingly, support structures 200 provide structural support to butterfly plate 182, such that the steam flow path external to plate portions 184 and 186 remains relatively unimpeded. For other structural arrangements of an upper exhaust hood, different structural connections may be provided to support the butterfly plate from the upper exhaust hood. For example but not shown, the butterfly plate may extend and be supported from a sidewall of the upper exhaust hood 100. In all such arrangements, when the upper exhaust hood 100 is lifted, the butterfly plate 1182 is also lifted since it is mechanically attached to the upper exhaust hood 100.

When access is required to the inside of the exhaust hood 100 or inside the turbine inner casing 25, access may be provided through man-way covers 230 or other provided man-way access points. For major work within the exhaust hood or removal of major components, the upper exhaust hood 100 may be removed. Such access may be required for preventive maintenance, repair maintenance or modification. Due to the significant size and weight of the upper exhaust hood, means for lifting, such as a heavy-duty overhead crane, is often used to perform the lifting. Studies performed to analyze construction cost of a gas turbine power plant suggests that about $300,000 to $350,000 per meter of facility height or up to about $10,000 per inch of facility height is required to provide concrete block walls for such a facility.

Accordingly, it would be desirable to provide turbine equipment and methods for limiting required lift height and thus allow lower power plant wall height and hence lower facility costs.

BRIEF DESCRIPTION OF THE INVENTION

Briefly in accordance with one aspect of the present invention, a method is provided for limiting clearance height necessary to lift an upper exhaust hood of the exhaust hood for a steam turbine with a turbine inner casing, where the steam turbine includes limiting height interference components within the upper exhaust hood. The method includes providing a limiting height interference component, mounted within an upper exhaust hood of the steam turbine, with a limiting height interference section that is detachable from the steam turbine. The method further includes coupling the limiting height interference section to a support structure within the upper exhaust hood, where the support structure is coupled to the upper exhaust hood. The method also includes detaching the limiting height interference section from the limiting height interference component and supporting the limiting height interference section from the support structure within the upper exhaust hood. The limiting height interference section is lifted with the upper exhaust hood.

Another aspect of the present invention provides an arrangement for removing an upper exhaust hood section for a steam turbine. The arrangement includes a steam turbine and an exhaust hood for the steam turbine, where the exhaust hood includes an upper exhaust hood and lower exhaust hood joined at a horizontal joint. A turbine inner casing is disposed within the exhaust hood. A steam guide is disposed at an exhaust outlet of the turbine inner casing. A limiting height clearance section of the steam guide is detachable from the steam guide. Means for coupling the detachable limiting height clearance section of the steam guide with the upper exhaust hood are provided. A lifting device is disposed at a location permitting a lifted upper exhaust hood to pass over remaining height limiting clearance components of the steam turbine.

According to a further aspect of the present invention, a steam turbine is provided. The steam turbine includes an exhaust hood, where the exhaust hood includes an upper exhaust hood and lower exhaust hood joined at a horizontal flange. A turbine inner casing is disposed centrally within the exhaust hood. A steam guide is disposed at an exhaust outlet from the turbine inner casing, including a removable upper steam guide segment. Means are provided for coupling the removable upper steam guide segment of the steam guide to the upper exhaust hood to allow lifting of the upper removable steam guide segment when the upper exhaust hood is lifted.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

To lift an upper exhaust hood free and away from a lower exhaust hood and inner turbine casing, the upper exhaust hood must vertically clear the highest limiting clearance component fixed to the inner casing or remaining within the exhaust hood space. The following embodiments of the present invention have many advantages, including limiting facility height and thereby allowing a substantial cost reduction for a power plant facility by providing a detachable section of the steam guide that is easily removable from the turbine inner casing and which may be lifted jointly with the upper exhaust hood. Such a cost savings may amount to about $10,000 per inch of power plant height. The lifting arrangement clears the highest component at a significant height differential compared to prior art arrangements for steam guides, potentially saving the power plant operator significant facility costs by allowing a lower wall height on the power plant facility housing the steam turbine.

Figure 1:
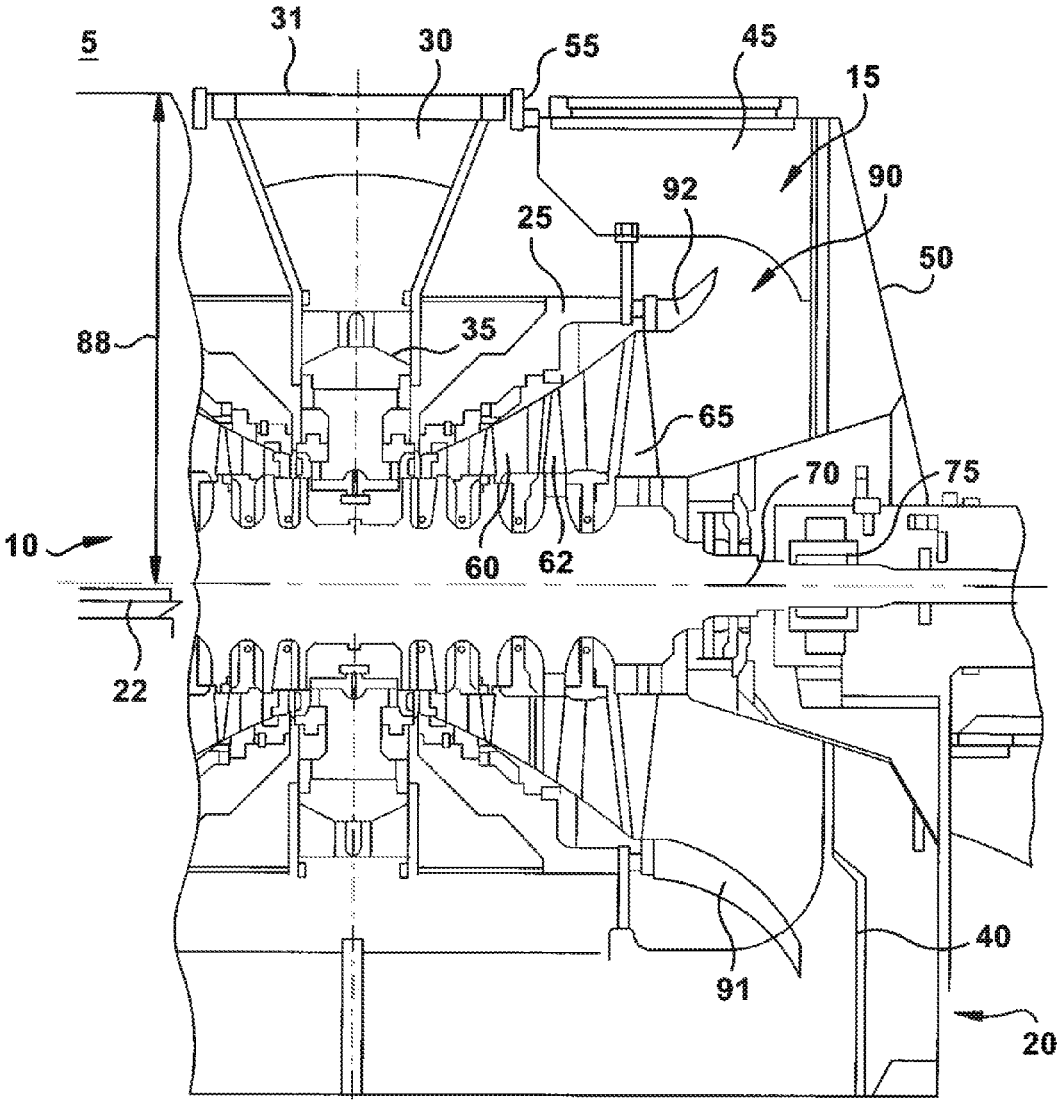
FIG. 1 (Prior Art)
FIG. 1 illustrates typical arrangements of a prior art low-pressure double-flow steam turbine with an exhaust hood.

Again referring to prior art of FIG. 1, an upper section 92 of the steam guide 90 is rigidly fixed integral part of the steam guide. The steam guide is large and cannot be easily removed from the turbine inner casing 25 with the upper exhaust hood 15 installed. Further for a steam turbine 5 with a removable steam inlet assembly 130 (FIG. 9), the top of the steam guide may form the highest point that the upper exhaust hood 15 must clear to be lifted free and away from the lower exhaust hood 20 and turbine inner casing 25. A height of the top of the steam guide above the next most limiting height clearance component (the steam inlet for the turbine inner casing) may be about 28 inches for an exemplary arrangement. Therefore, to remove the upper exhaust hood 15, the upper exhaust hood must be lifted above top of the upper steam guide 92, which is the limiting clearance height for such a lift.

According to an embodiment of the present invention, an arrangement is provide for a detachable upper steam guide segment for a steam turbine. The steam guide is attached to an exhaust outlet from the last stage of the turbine inner casing. The steam guide may be formed as a bell mouth with the narrow upstream end receiving the exhaust from the turbine inner casing and a flared end exhausting steam into the exhaust hood. According to the present invention, a circumferential upper radial segment (hereinafter referred to as removable segment) of the steam guide is made detachable. A steam guide support bracket is provided that is attachable to the removable segment. The steam guide support bracket is sized axially to extend from the removable segment to a butterfly plate disposed axially upstream from the removable upper steam guide segment. The steam guide support bracket may be fixedly attached to the butterfly plate by known means such as welding. With the steam guide support bracket fixed to the butterfly plate and attached to the removable segment, the removable segment may be detached from the full steam guide, leaving the removable segment supported through the steam guide support bracket by the butterfly plate. During a lift of the upper exhaust hood, since the butterfly plate is attached to and lifted with the upper exhaust hood, the steam guide segment will also be lifted with the upper exhaust hood, resulting in a lower clearance height for the lift.

Figure 3:
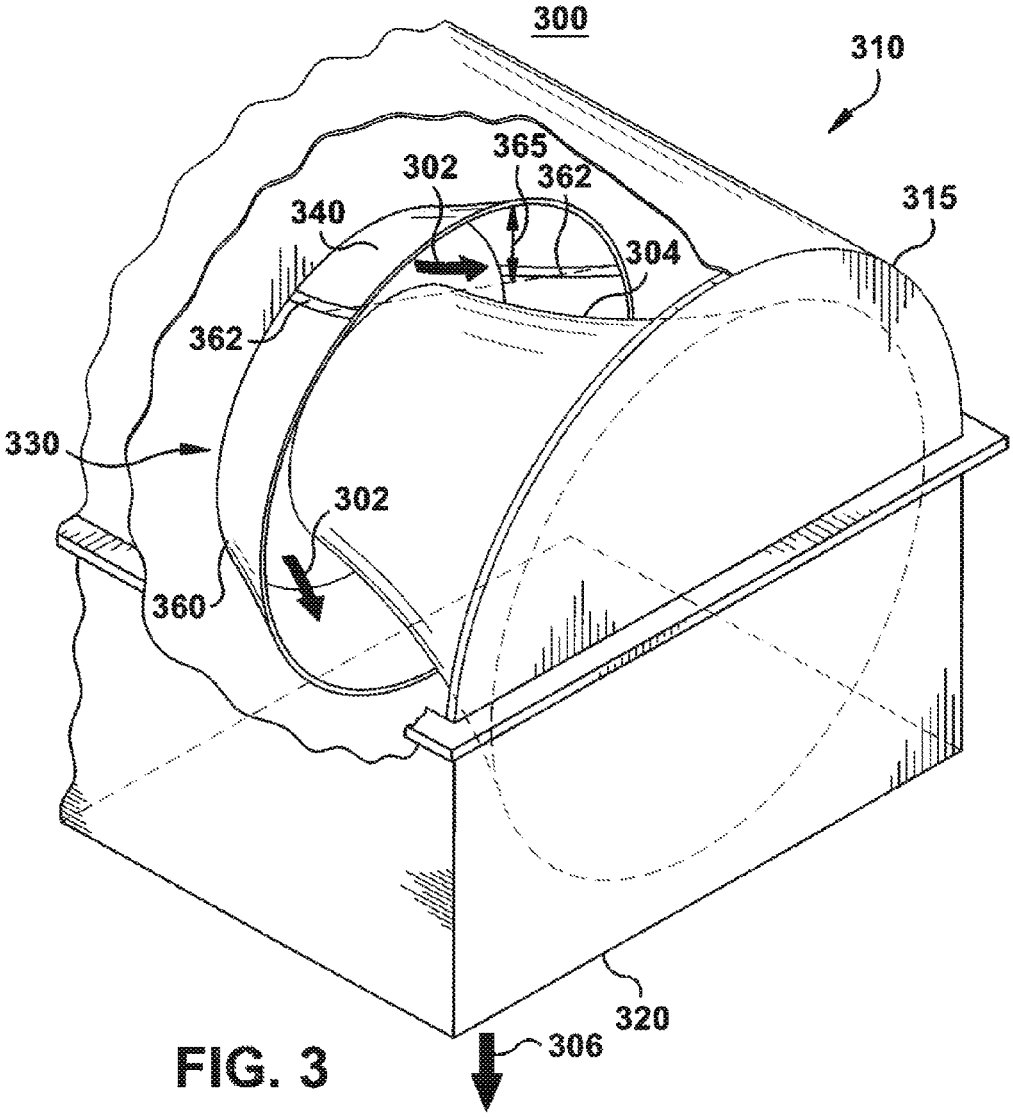
FIG. 3 illustrates a simplified representation of a steam guide with a removable steam guide segment.

FIG. 3 illustrates a simplified representation of a steam guide 330 with a removable upper steam guide segment 340. Exhaust hood 310 for steam turbine 300 includes upper exhaust hood 315 and lower exhaust hood 320. Steam 302 exhausts from turbine inner casing (not shown) between steam guide and bearing cone 304. The exhaust steam 302 may flow directly below to condenser (not shown) or may flow into upper exhaust hood 315 and then be directed downward 306 to the condenser. A removable upper steam guide segment 340 may be provided that detaches along boundary joint 362 on each lateral side from the fixed body segment 360 of the steam guide 330. The removable upper steam guide segment 340 includes a height 365. By making the removable upper steam guide segment 340 detachable from the fixed segment 360 of the steam guide 330 and removable with the upper exhaust hood 315, the upper exhaust hood has only to be lifted above boundary joint 362 to clear the steam guide interference.

Figure 4:
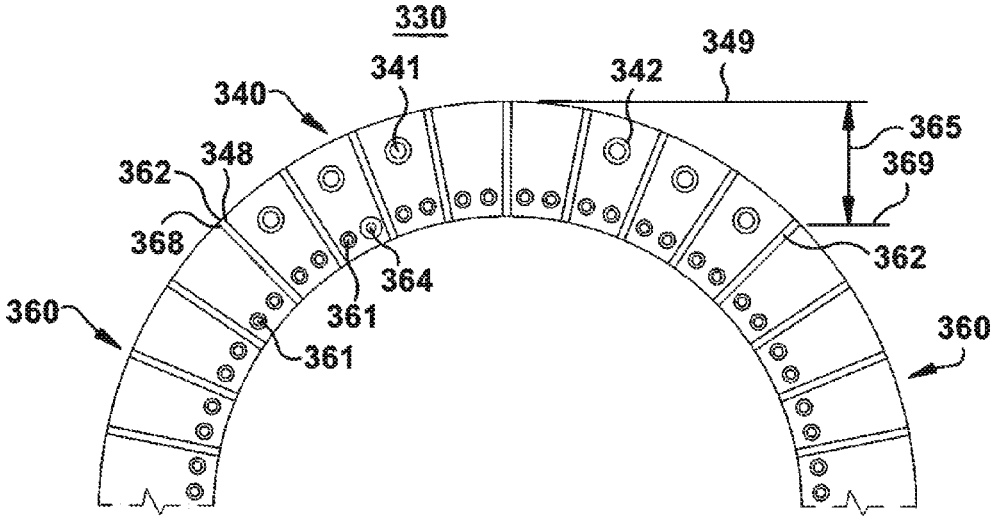
FIG. 4 illustrates an upstream view of the upper half of the steam guide with the removable upper steam guide segment.
Figure 5:
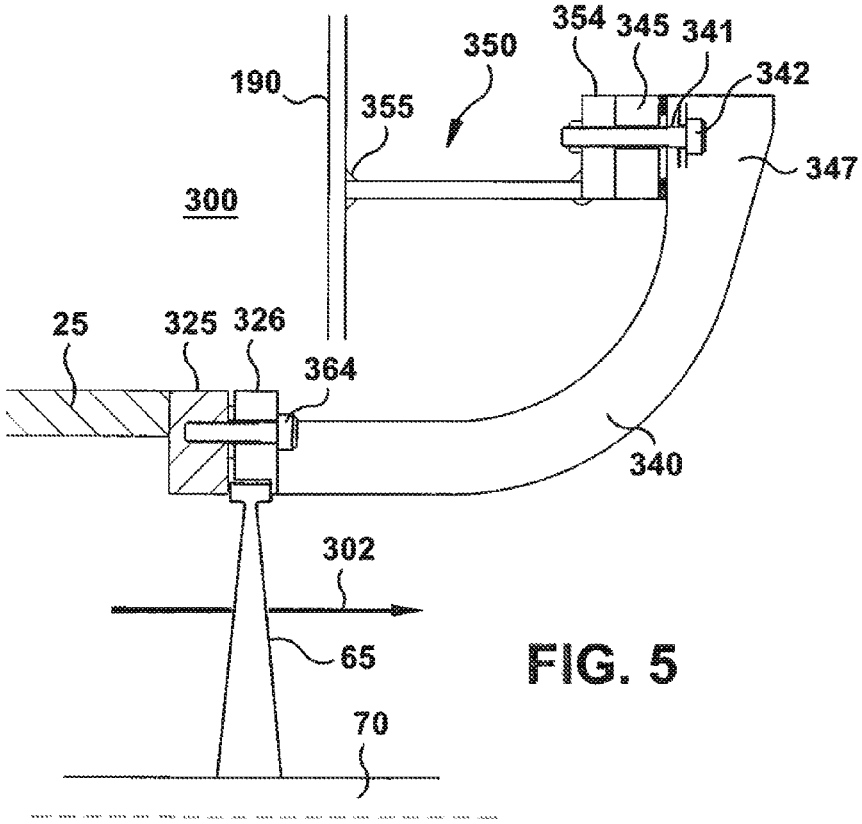
FIG. 5 illustrates a side view of cutaway portion of the upper removable steam guide segment.
Figure 6:
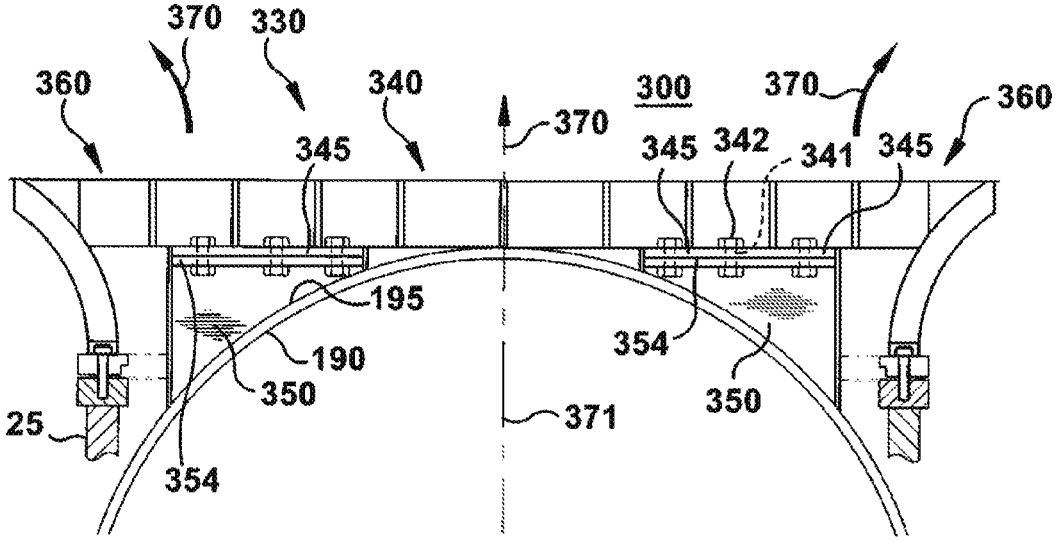
FIG. 6 illustrates a top view of the support arrangement for the removable segment of the steam guide within the exhaust hood.

FIG. 4 illustrates an upstream view of an embodiment of an upper half of the steam guide including the removable upper steam guide segment. The steam guide 330 includes an inner ring of axial-directed holes 361 through which bolts 364 (FIG. 5) attach the steam guide to the turbine inner casing 25 in the vicinity of the last stage turbine buckets 65 (FIG. 5). The removable upper steam guide segment 340 also includes bolts 364 and bolt holes 361 of the inner ring. For the removable segment 340, the bolts 364 and bolt-holes 361 are used for initial installation of the steam guide 330 before the upper exhaust hood 315 is lowered over the open lower exhaust hood 320 with turbine inner casing 25 and steam guide. The removable segment 340 also includes a bolting pattern with bolts 342 and bolt holes 341 disposed in proximity to its outer radius 347 for attaching to support bracket 350 (FIG. 6) attached to butterfly plate 182 (FIG. 6). The inner-ring bolts 391 on the removable segment 340 may be removed after the removable segment has been attached to the support bracket 350 carried by the butterfly plate 182. Outer circumferential ends 348 of the removable segment 340 abut the outer circumferential ends 368 of stationary steam guide segments 360 against exhaust steam leakage. Distance 365 between the outer radial height 369 of the stationary steam guide segments 360 and the outer radial height 349 of the removable segment 340 represents the reduced height not needed to be cleared during a lift of the upper exhaust hood 315 (FIG. 3) with the removable segment detached.

FIG. 5 illustrates a side view of cutaway portion for an embodiment of the removable upper steam guide segment. A last stage turbine bucket 65 extends from the turbine rotor 70 to the turbine inner casing 25. Turbine steam flow 302 is indicated by arrow. The upstream inner-radial endplate 326 of the removable segment 340 attaches to an inner portion 325 of the turbine inner casing 25 with bolts 364. These bolts 364 may be removed for the removable segment 340 of the steam guide 330 after the removable segment has been attached to the support bracket 350 (FIG. 4) carried from the butterfly plate 182 (FIG. 4). The downstream outer radial end 347 of the removable segment 340 is bolted to end flange 354 of support bracket 350 with outer-ring bolts 342 through bolt holes 341.

Figure 2:
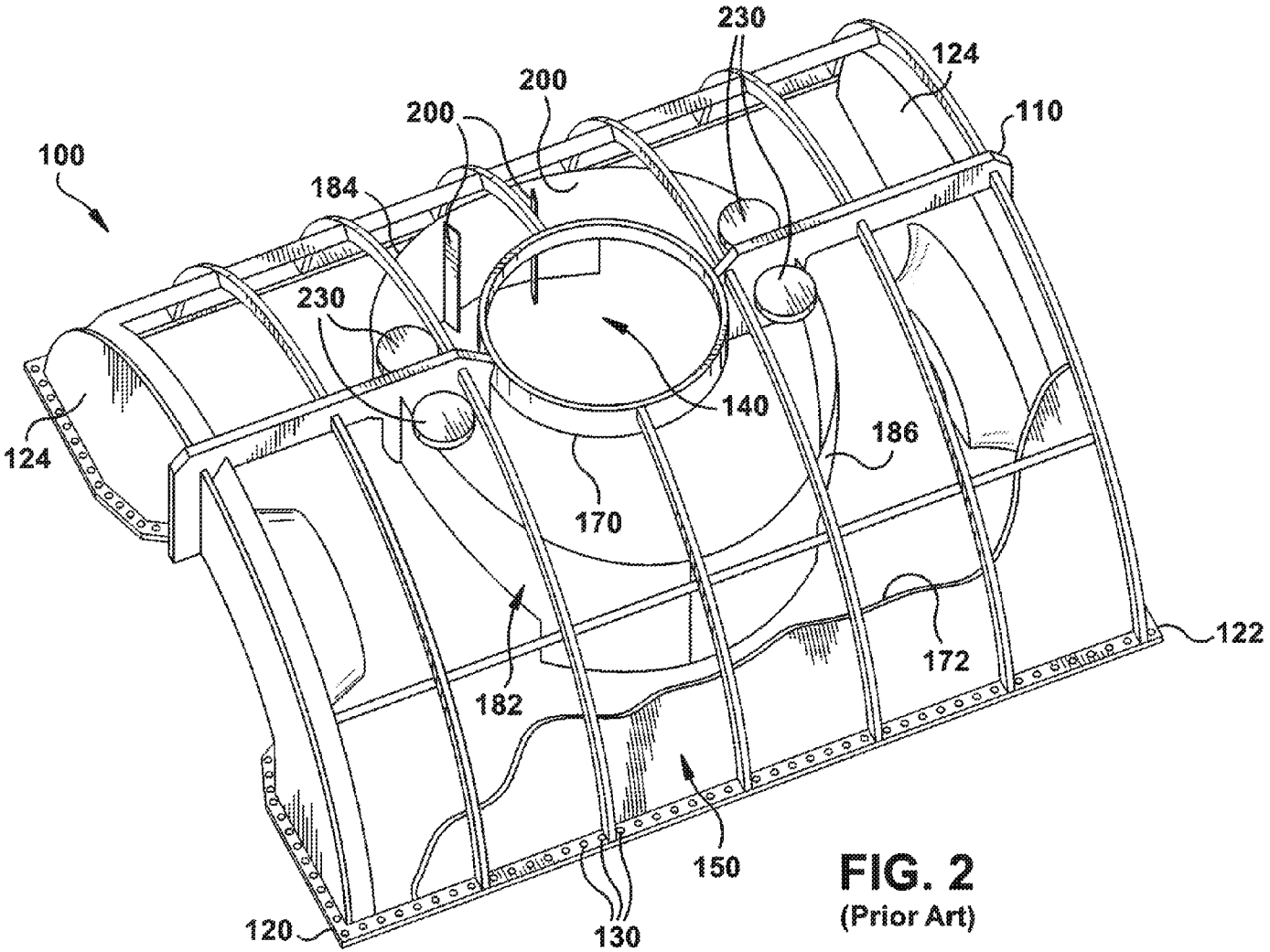
FIG. 2 (Prior Art)
FIG. 2 illustrates an isometric cutaway view of a prior art upper exhaust hood with a butterfly plate.

FIG. 6 illustrates a top view of an embodiment for a support arrangement for the removable segment of the steam guide within the exhaust hood. The exhaust flow 370 from the steam guide 340 shows the orientation relative to steam turbine centerline 371. Butterfly plate 182 is supported from the upper exhaust hood 100 (See FIG. 2). Fixed steam guide segment 360 is supported from turbine inner casing 25. Removable segment 340 includes an upstream flange(s) 345 fixedly attached to upstream side of the removable segment. Bolt holes 341 extending from downstream side of removable segment 340 extend through the upstream flange 345. Removable segment flanges 345 attach to support plate 350, providing support for removable segment 340 from butterfly plate 182. In this representation, two flanges 345 are shown, one on each side of turbine centerline 371, because in this case, the butterfly plate 182 is shown overlapping removable segment 340 at the centerline 371. Other possible arrangements could include direct attachment of the removable segment to the butterfly plate at the centerline. If the butterfly plate were separated at an axial distance from the removable segment 340 across the full transverse width of the removable segment, then the support flange 345 could extend across the full width of the removable segment.

Figure 7:
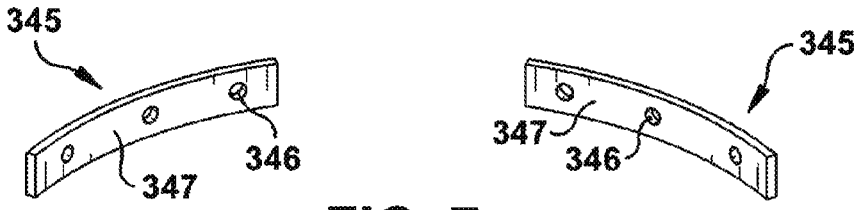
FIG. 7 illustrates one embodiment of the removable upper steam guide support bracket(s)
Figure 8:
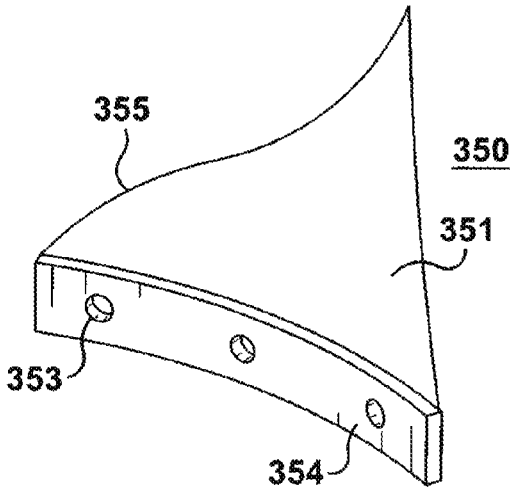
FIG. 8 illustrates a support plate for coupling the removable upper steam guide segment to a butterfly plate of the upper exhaust hood.

FIG. 8 illustrates one embodiment of the removable upper steam guide support bracket(s) 350 (hereinafter referred to as support bracket) attaches between butterfly plate 182 (FIG. 6) and upstream flange 345 (FIG. 6) of removable segment 340 (FIG. 6) to support the removable segment. The support bracket 350 includes an end flange 354 shaped to conform to the shape of upstream flange 345 (FIG. 7). The end flange 354 includes bolt-holes 353 arranged in alignment with the bolt-holes 346 of upstream flange 345 of the removable segment 340 for attaching the removable segment 340 to the support bracket 350. A support plate 351 of the support bracket extends between end flange 354 and the butterfly plate 182

(FIG. 6). The upstream end 355 of support plate 350 is shaped to attach to the curved surface 195 (FIG. 6) of the butterfly plate 182. The upstream end 355 may be fixedly attached to the butterfly plate 182 by weld or other known means. The support plate 350 may be fixedly attached to the end plate 354 by weld or other known means.

Figure 9:
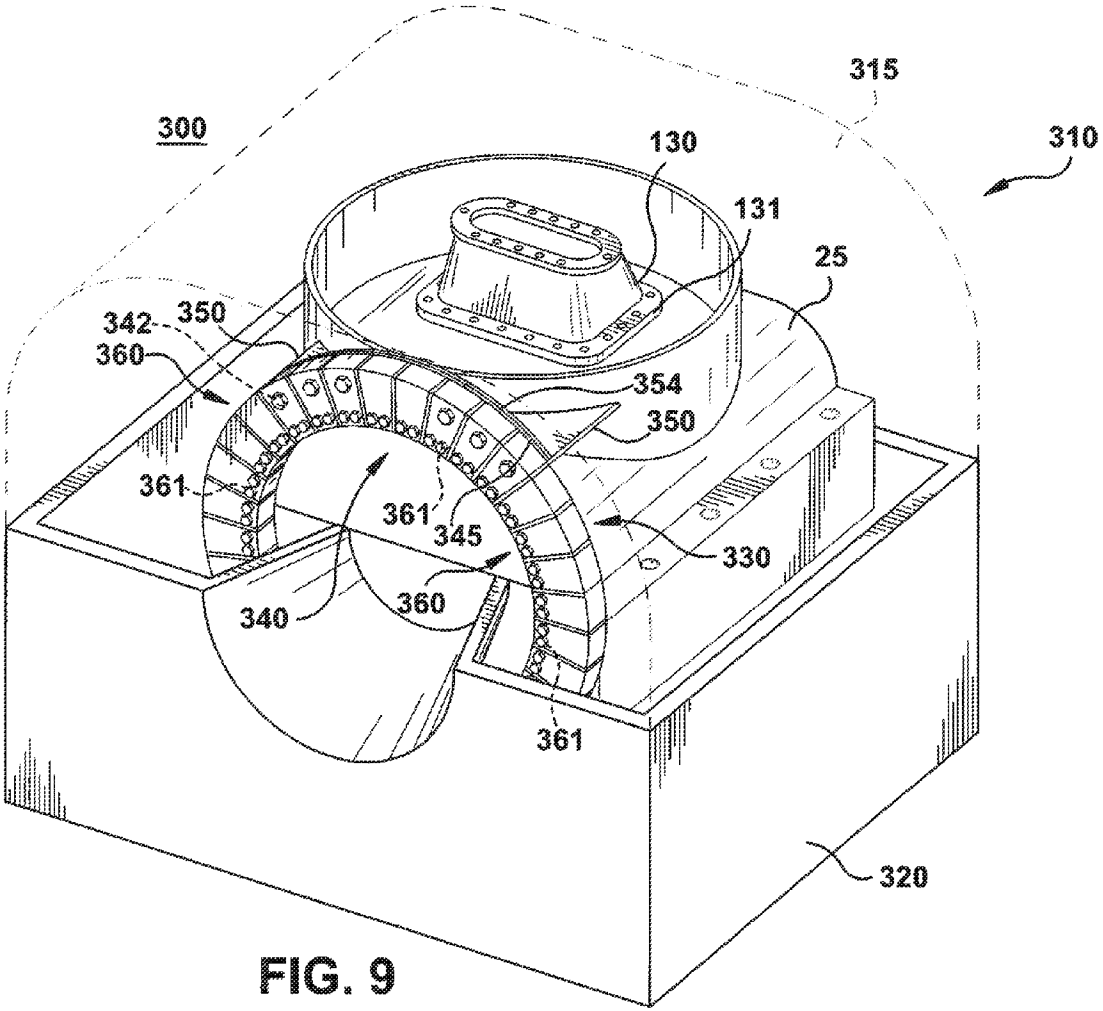
FIG. 9 illustrates an isometric cutaway view of an embodiment of a steam turbine and exhaust hood with a removable upper steam guide segment and FIG. 10 illustrates a flow chart for an inventive method for limiting clearance height needed for installation and removal of the upper exhaust hood casing of a steam turbine.

FIG. 9 illustrates an isometric cutaway view of an embodiment of a steam turbine 300 and exhaust hood 310 with a removable upper steam guide segment 340. Turbine inner casing 25 is mounted within exhaust hood 310. During initial assembly of the steam turbine prior to installation of the upper exhaust hood 315, the steam guide 330 is installed by bolting inner-ring bolts 361 to end flange (not shown) of turbine inner casing 25 (FIG. 5). After upper exhaust hood 315 is seated over lower exhaust hood 320, support plate 350 attached at upstream end to butterfly plate 182 has downstream end flange 354 bolted through upstream flange 345 to the removable segment 340 of steam guide. The removable segment 340 may be bolted to end flange 354 of support plate 350 through outer ring bolts 342, is seated over the lower exhaust hood 320. After being fitted in place with bolting, the upstream flange 345 of the removable segment 340 may be permanently welded to support plate 350, thereby establishing permanent coupling to upper exhaust hood 315 through butterfly plate 182 connection (FIG. 2) to upper exhaust hood. After being fixed to upper exhaust hood 315 through support plate 350 and butterfly plate 182, inner ring bolts 361 of the removable segment 340 may be unbolted from turbine inner casing 25 so removable segment 340 may be free to lift with lifting of upper exhaust hood.

Consequently, in a lift for a steam turbine with a removable steam inlet assembly 130 (FIG. 9) and also providing a removable upper steam guide segment 340 where the highest point of the removable segment constitutes a limiting height clearance component, the required lift of the upper exhaust hood 115 is reduced by the height 365 of removable segment 340 of the steam guide 330. In an exemplary case, with the height of the detachable upper section of the steam guide is approximately 28 inches above the next limiting height clearance component (fixed portion 360 of steam guide) within the upper exhaust hood, a reduction of the height of the necessary for lifting the exhaust hood by 28 inches may allow the turbine power plant building height to be reduced by the same 28 inches. The savings on building construction of lowering the building height by 28 inches may be approximated by Equation 1:

$$\text{Cost Savings}=28\text{ inches (height reduction)}\times\$10{,}000\text{ (per inch of wall height)}=\$280{,}000 \qquad \text{Equation 1.}$$

A method is also provided for installation and removal of an upper exhaust hood on a steam turbine with a removable upper steam guide section. For initial installation onto the open exhaust hood before the upper exhaust hood is set in place, the removable upper steam guide section 340 is mounted with the full steam guide 330 to the turbine inner casing 25 with inner ring bolts 364 (FIGS. 4, 5). The steam turbine 300 (FIG. 9) is provided with a support structure for the removable upper steam guide, where the support structure (support plate 350 coupled to butterfly plate 182) is mounted to the upper exhaust hood 315. When the upper exhaust hood 315 is mounted on the lower exhaust hood 320, the support structure aligns with upstream flange 345 of the removable upper steam guide section 340. The removable upper steam guide section 340 is then attached to the support structure. Once coupled to the upper exhaust hood 315, the removable upper steam guide section 340 may be detached from the fixed section 360 of steam guide 330 by removing the inner ring bolts 364 for the section from the turbine inner casing 25. When detached from the turbine inner casing 25, the removable upper steam guide section 340 will be lifted by the support structure during a lift of the upper exhaust hood 315. Because the removable upper steam guide section 340 lifts with the exhaust hood 315, it will not present a height clearance obstacle, requiring the upper exhaust hood to be lifted only above the height 369 (FIG. 4) of the fixed portion 360 of the steam guide 330, which becomes a new clearance limiting height clearance component.

Figure 10:
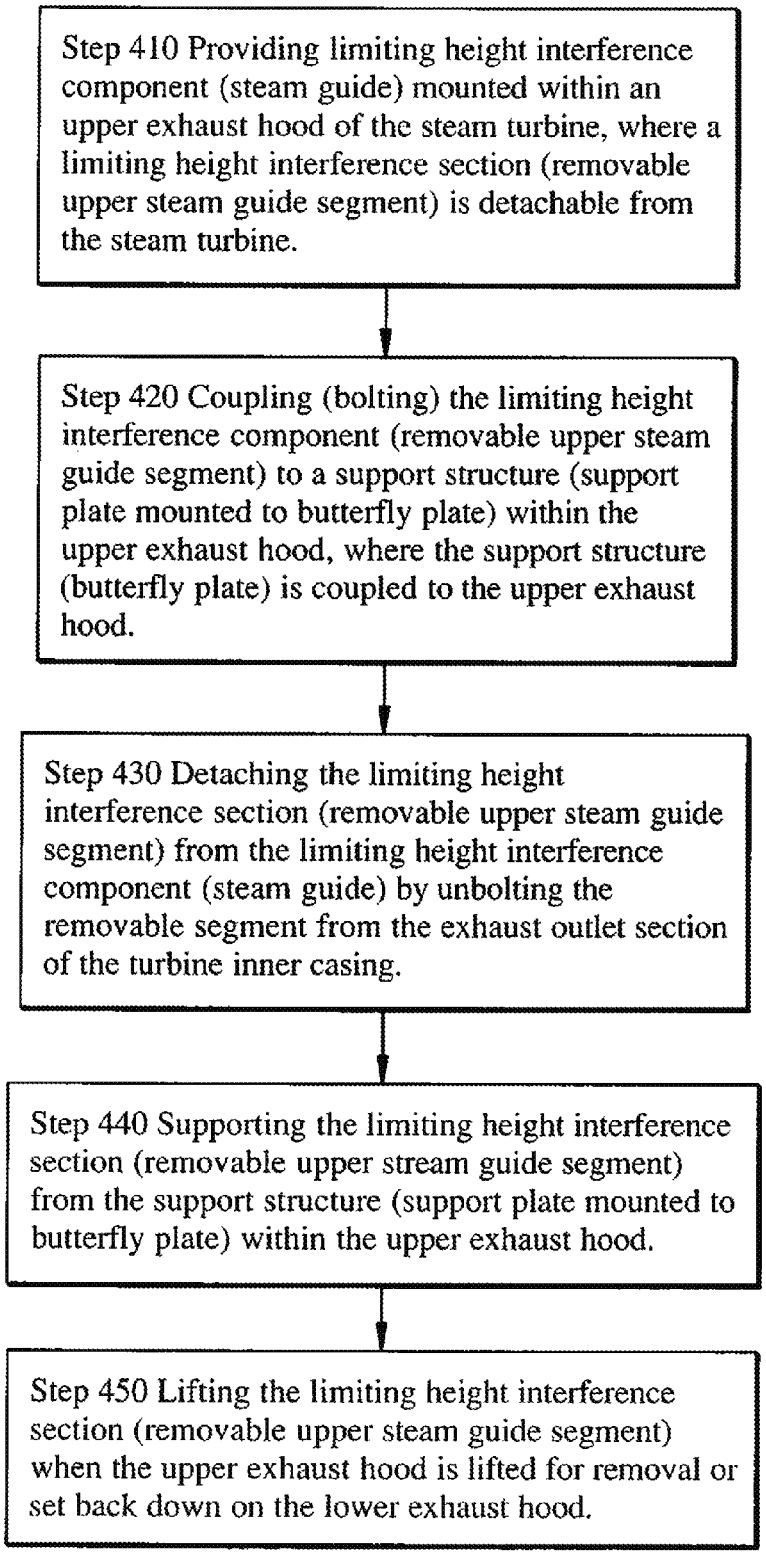

FIG. 10 illustrates a flow chart for an inventive method for limiting clearance height needed for installation and removal of the upper exhaust hood casing of a steam turbine with complimentary upper and lower exhaust hoods that include limiting height interference components within the upper exhaust hood. Step 410 provides a limiting height interference component (steam guide) mounted within an upper exhaust hood of the steam turbine, where a limiting height interference section (removable upper steam guide segment) is detachable from the steam turbine. Step 420 couples (bolts) the limiting height interference component (removable upper steam guide segment) to a support structure (support plate mounted to butterfly plate) within the upper exhaust hood, where the support structure (butterfly plate) is coupled to the upper exhaust hood. Step 430 detaches the limiting height interference section (removable upper steam guide segment) from the limiting height interference component (steam guide) by unbolting the removable segment from the exhaust outlet section of the turbine inner casing. Step 440 supports the limiting height interference section (removable upper steam guide segment) from the support structure within the upper exhaust hood. Step 450 lifts the limiting height interference section when the upper exhaust hood is lifted for removal or set back down on the lower exhaust hood.

While various embodiments are described herein, it will be appreciated from the specification that various combinations of elements, variations or improvements therein may be made, and are within the scope of the invention.

The invention claimed is:

1. A method for limiting clearance height necessary to lift an upper exhaust hood of the exhaust hood for a steam turbine with a turbine inner casing, wherein the steam turbine includes limiting height interference components within the upper exhaust hood, the method comprising:

providing a limiting height interference component, mounted within an upper exhaust hood of the steam turbine, with a limiting height interference section that is detachable from the steam turbine;

coupling the limiting height interference component to a support structure within the upper exhaust hood, the support structure being coupled to the upper exhaust hood;

detaching the limiting height interference section from the limiting height interference component;

supporting the limiting height interference section from the support structure within the upper exhaust hood; and lifting the limiting height interference section with the upper exhaust hood.

2. The method of claim 1, the step of making a limiting height interference component within the upper exhaust hood detachable from the steam turbine further comprising:

providing a detachable joint between the limiting height interference component and the support structure within the upper exhaust hood.

3. The method of claim 2, wherein the limiting height interference component is a steam guide for the turbine exhaust and the limiting height interference section is an upper steam guide segment of the steam guide.

4. The method of claim 3, wherein the upper steam guide segment of the steam guide comprises an upper circumferential segment of the steam guide.

5. The method of claim 3, the step of coupling comprising:

attaching the upper steam guide segment to a support structure fixed to the upper exhaust hood after initial factory installation of the upper steam guide on the steam turbine.

6. The method of claim 5, the step of detaching comprising:

detaching a jointed connection between the upper steam guide segment and a turbine inner casing after initial factory installation of the the upper steam guide on the steam turbine.

7. The method of claim 6, wherein the support structure comprises:

a butterfly plate within the exhaust hood; and at least one support plate coupled between the butterfly plate and the upper steam guide segment.

8. The method of claim 7 wherein the butterfly plate is coupled to the upper exhaust hood of the steam turbine.

9. The method of claim 8, wherein the at least one support plate coupled between the butterfly plate and the upper steam guide segment includes an end flange and wherein the upper steam guide segment includes at least one upstream flange, the at least one end flange and the at least one upstream flange providing a bolted interface supporting the upper steam guide segment from the support plate.

10. The method of claim 1, lifting the limiting height interference section with the upper exhaust hood comprising:

lifting the upper steam guide segment with upper exhaust hood.

11. An arrangement for removing an upper exhaust hood section for a steam turbine, the arrangement comprising:

a steam turbine;

an exhaust hood for the steam turbine, the exhaust hood including an upper exhaust hood and lower exhaust hood joined at a horizontal joint;

a turbine inner casing disposed within the exhaust hood;

a steam guide disposed at an exhaust outlet of the turbine inner casing;

a detachable limiting height clearance section of the steam guide;

means for coupling the detachable limiting height clearance section of the steam guide with the upper exhaust hood; and a lifting device disposed at a location permitting a lifted upper exhaust hood to pass over remaining height limiting clearance components of the steam turbine.

12. The arrangement of claim 10, wherein the steam guide comprises:

a bolting arrangement to the exhaust outlet of the turbine inner casing;

a removable upper steam guide section coupled to the upper exhaust hood after initial installation wherein the removable upper steam guide section is unbolted from the exhaust outlet of the turbine inner casing.

13. The arrangement of claim 11, wherein the detachable height limiting clearance section of the steam guide comprises the removable upper steam guide segment of the steam guide.

14. The arrangement of claim 12, further comprising:

a butterfly plate disposed transverly and vertically within the upper exhaust hood between the detachable height clearance section of the steam guide and the steam inlet to the turbine inner casing, wherein the butterfly plate is coupled to the upper exhaust hood.

15. The arrangement of claim 14, wherein the means for coupling the detachable limiting height clearance section of the steam guide with the upper exhaust hood further comprises at least one support bracket coupling the removable upper steam guide segment of the steam guide to the butterfly plate.

16. The arrangement of claim 15, the support bracket including an end flange fastened to an upstream flange of the removable upper steam guide segment of the steam guide with a bolting arrangement.

17. A steam turbine comprising:

an exhaust hood for the steam turbine, the exhaust hood including an upper exhaust hood and lower exhaust hood joined at a horizontal flange;

a turbine inner casing disposed centrally within the exhaust hood;

a steam guide disposed at an exhaust outlet from the turbine inner casing, including a removable upper steam guide segment; and means for coupling the removable upper steam guide segment of the steam guide to the upper exhaust hood.

18. The steam turbine according to claim 17, wherein means for coupling the removable upper steam guide segment to the upper exhaust hood comprises:

a butterfly plate attached to the upper exhaust hood; and at least one support plate with an end flange attached between the butterfly plate and the removable upper steam guide segment, supporting the removable upper steam guide segment.

19. The steam turbine according to claim 18, wherein the removable upper steam guide segment includes a bolting ring and at least one upstream flange wherein the end flange of the at least one support plate bolts to the at least one upstream flange of the removable upper steam guide segment.

20. The steam turbine according to claim 17, wherein the means for coupling the removable upper steam guide segment of the steam guide to the upper exhaust hood cause the removable upper steam guide segment to be lifted during a lift of the upper exhaust hood, lowering the lift clearance height for upper exhaust hood.

* * * * *

UNITED STATES PATENT AND TRADEMARK OFFICE

CERTIFICATE OF CORRECTION

PATENT NO. : 8,668,450 B2
APPLICATION NO. : 12/980624
DATED : March 11, 2014
INVENTOR(S) : Chevrette It is certified that error appears in the above-identified patent and that said Letters Patent is hereby corrected as shown below:

In the specification,

In Column 3, Line 14, delete "1182" and insert -- 182 --, therefor.

In Column 4, Line 44, delete "segment and" and insert -- segment; and --, therefor.

In the claims,

In Column 9, Line 15, in Claim 6, delete "the the" and insert -- the --, therefor.

In Column 10, Line 9, in Claim 14, delete "transverly" and insert -- transversely --, therefor.

Signed and Sealed this
Fourteenth Day of April, 2015

Michelle K. Lee

Michelle K. Lee
*Director of the United States Patent and Trademark Office*